US010668475B2

(12) United States Patent
Raihala et al.

(10) Patent No.: US 10,668,475 B2
(45) Date of Patent: Jun. 2, 2020

(54) PULVERIZER ATTACHMENT WITH TOOTH RAILS

(71) Applicant: Genesis Attachments, LLC, Superior, WI (US)

(72) Inventors: Daniel Raihala, Superior, WI (US); Roger Johnson, Hermantown, MN (US)

(73) Assignee: Genesis Attachments, LLC, Superior, WI (US)

( * ) Notice: Subject to any disclaimer, the term of this patent is extended or adjusted under 35 U.S.C. 154(b) by 120 days.

(21) Appl. No.: 15/753,545

(22) PCT Filed: Jan. 31, 2017

(86) PCT No.: PCT/US2017/015910
§ 371 (c)(1),
(2) Date: Feb. 19, 2018

(87) PCT Pub. No.: WO2017/132705
PCT Pub. Date: Aug. 3, 2017

(65) Prior Publication Data

US 2018/0326425 A1 Nov. 15, 2018

Related U.S. Application Data

(60) Provisional application No. 62/289,294, filed on Jan. 31, 2016.

(51) Int. Cl.
*B02C 1/02* (2006.01)
*B02C 1/00* (2006.01)
(Continued)

(52) U.S. Cl.
CPC ..... *B02C 1/10* (2013.01); *B02C 1/06* (2013.01); *E02F 3/965* (2013.01); *E04G 23/082* (2013.01)

(58) Field of Classification Search
CPC .... B02C 1/02; B02C 1/04; B02C 1/06; B02C 1/10
See application file for complete search history.

(56) References Cited

U.S. PATENT DOCUMENTS 2,222,071 A 12/1938 Gustafson
2,609,154 A * 9/1952 Baker ..... B02C 1/10 241/300.1
(Continued)

FOREIGN PATENT DOCUMENTS

DE 9401815 U1 * 3/1994 ..... E02F 3/965
EP 2801671 A1 11/2014
GB 578292 A * 6/1946 ..... B02C 1/10

OTHER PUBLICATIONS

PCT International Search Report and Written Opinion, PCT Application No. PCT/US2017/015910, dated Apr. 4, 2017, 13 pages.
(Continued)

*Primary Examiner* — Adam J Eiseman
*Assistant Examiner* — Dylan Schommer
(74) *Attorney, Agent, or Firm* — Thomas J. Oppold; Larkin Hoffman Daly & Lindgren, Ltd.

(57) ABSTRACT

A pulverizing attachment for an excavator and a method of removably rigidly retaining teeth to one or more jaws of a pulverizer. A plurality of tooth members each have a longitudinal slot with a cross-sectional shape and a relief slot extending substantially transverse to the longitudinal slot producing a flexible end portion capable of deflection upon application of a longitudinal compression force. The tooth rails having a complimentary cross-sectional shape to the longitudinal slot slidably receive the tooth members. The complimentary shape of the longitudinal slot and tooth rail in cooperation with a longitudinal compression force applied to deflect the flexible end portions of each of the tooth
(Continued)

members rigidly retains the tooth members on the tooth rails fixed to the pulverizer jaws.

10 Claims, 9 Drawing Sheets

(51) Int. Cl.

| | |
|---|---|
| ***B02C 1/10*** | (2006.01) |
| ***E04G 23/08*** | (2006.01) |
| ***E02F 3/96*** | (2006.01) |
| ***B02C 1/06*** | (2006.01) |

(56) References Cited

U.S. PATENT DOCUMENTS

| | | | | |
|---|---|---|---|---|
| 2,851,225 | A * | 9/1958 | McMahan | B02C 1/10 241/300 |
| 4,512,524 | A | 4/1985 | Shigemizu | |
| 4,838,493 | A | 6/1989 | LaBounty | |
| 5,044,569 | A | 9/1991 | LaBounty et al. | |
| 5,301,882 | A | 4/1994 | Morikawa et al. | |
| 5,474,242 | A | 12/1995 | Rafn | |
| 5,636,802 | A | 6/1997 | Tagawa | |
| 5,715,603 | A | 2/1998 | Dorguin | |
| 5,822,893 | A | 10/1998 | Ostermeyer | |
| 6,119,970 | A | 9/2000 | LaBounty et al. | |
| 6,766,973 | B2 | 7/2004 | Muri | |
| 7,354,010 | B2 | 4/2008 | Ramun et al. | |
| 2009/0288300 | A1 | 11/2009 | Gregory, Jr. | |
| 2011/0031338 | A1 | 2/2011 | Ramun et al. | |
| 2011/0225829 | A1 | 9/2011 | Raihala | |
| 2012/0168543 | A1 * | 7/2012 | Ramun | E02F 3/965 241/30 |
| 2015/0115086 | A1 | 4/2015 | Van Gemert | |

OTHER PUBLICATIONS

Extended European Search Report from the European Patent Office, EP Application No. 17445114.3, dated Jun. 18, 2019; 23 pages.

* cited by examiner

PULVERIZER ATTACHMENT WITH TOOTH RAILS

BACKGROUND

Pulverizer or crushing-style attachments which mount to the stick of an excavator are known in the art. These pulverizers or crusher attachments have jaws with a plurality of hardened teeth arranged on the jaws to crush or pulverize the concrete as the jaws close. Because of the hardness and abrasiveness of the concrete, the teeth wear relatively rapidly and therefore require frequent replacement or refurbishment. In an effort to minimize downtime, those in the industry have attempted to design pulverizer attachments with jaws having replaceable teeth. However, such attempts have met with limited success because the teeth are not retained in a sufficiently rigid manner within the pocket or socket in which they bolted or otherwise removably fastened. If the tolerances between the teeth and the pocket in which they are fastened are such that the teeth are able to move or rock from side-to-side during use, the pocket will quickly wear out, requiring replacement of the pockets welded to the jaws along with the teeth. Accordingly, there is a need for a pulverizer attachment with replaceable teeth that rigidly retained on the jaws.

DESCRIPTION

Figure 1:
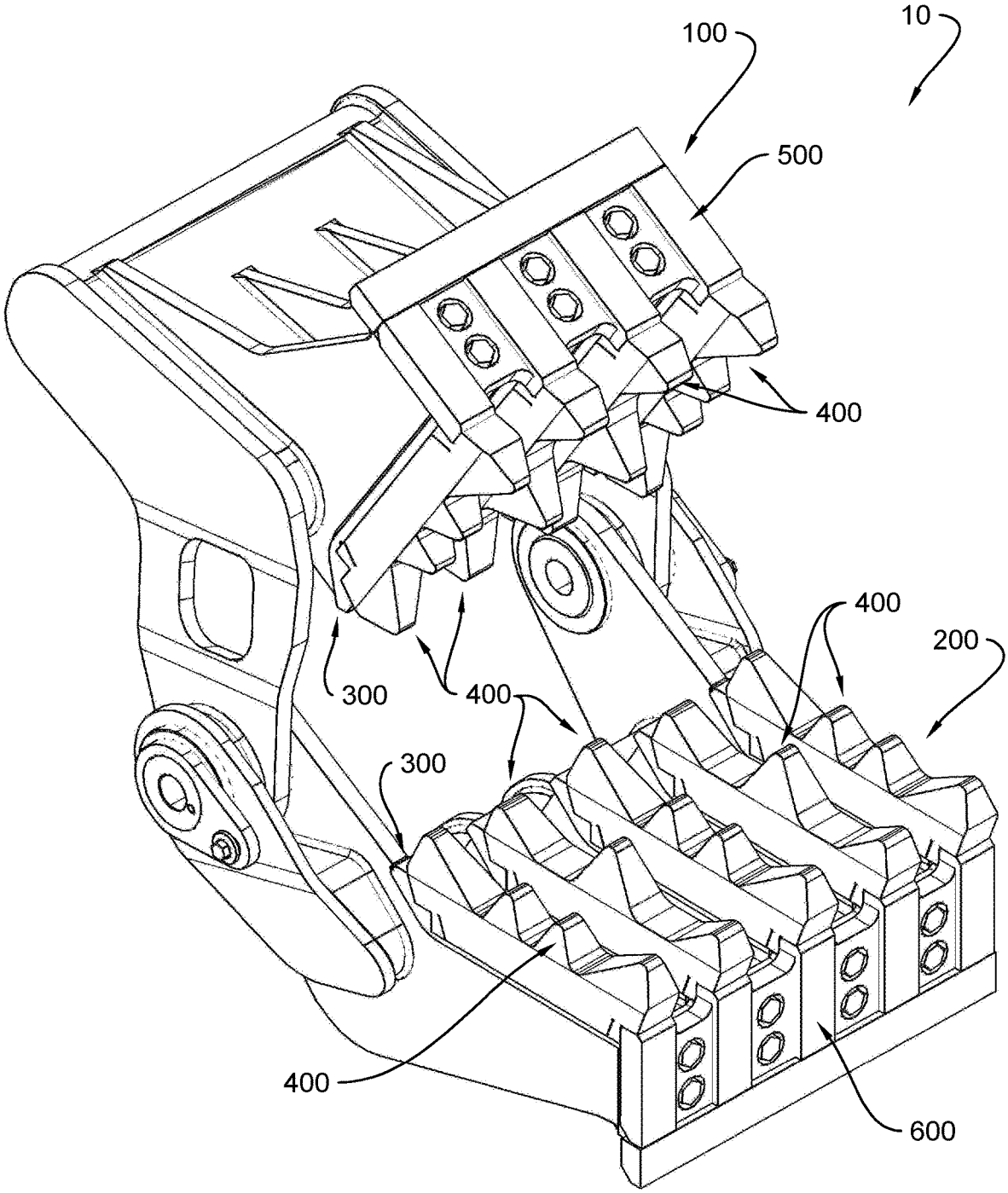
FIG. 1 is a front perspective view of an embodiment of the pulverizer attachment with tooth rails showing the jaws open.
Figure 2:
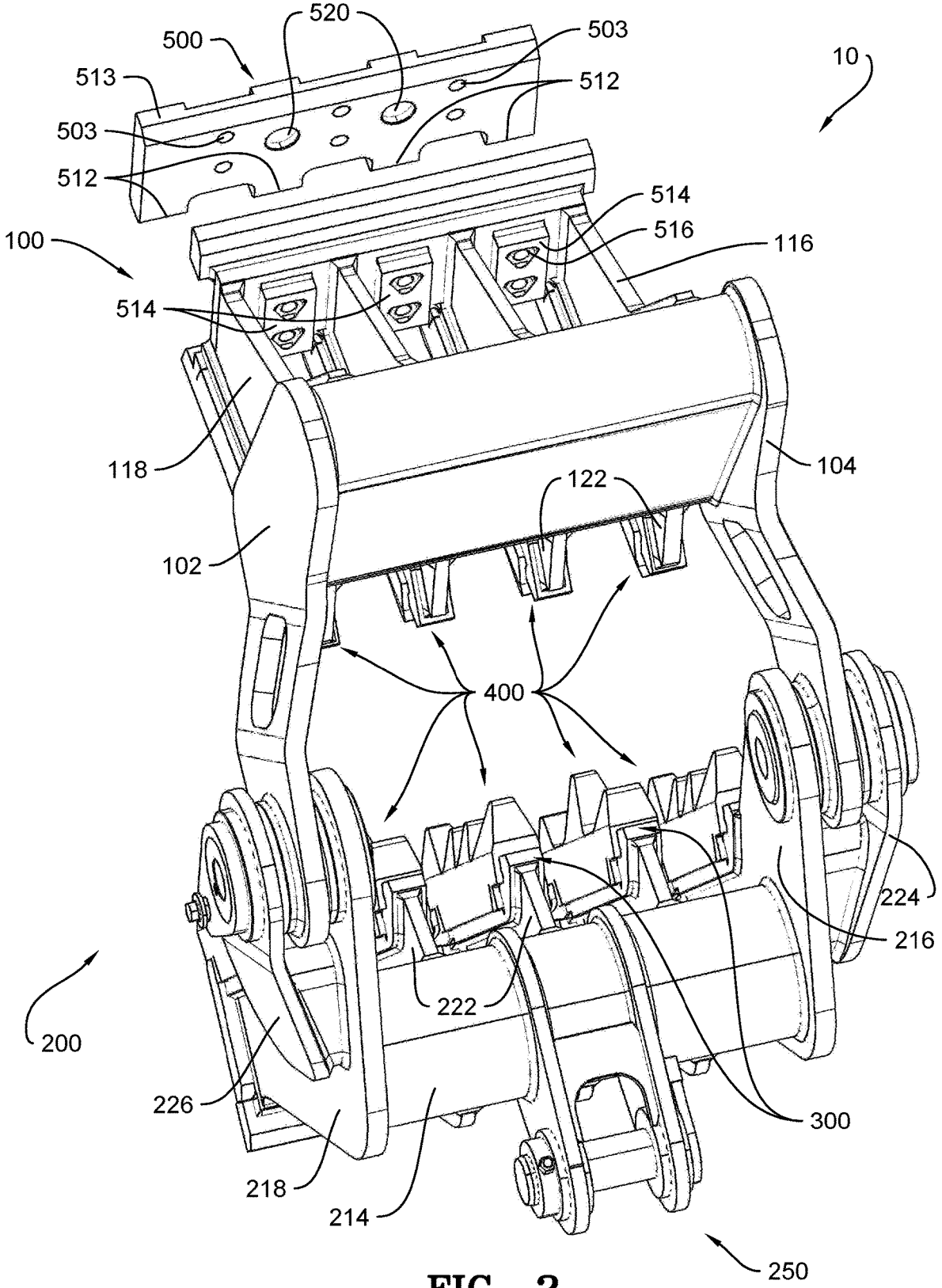
FIG. 2 is a rear perspective view of the pulverizer attachment of FIG. 1.

Referring now to the drawings wherein like reference numerals designate the same or corresponding parts throughout the several views, FIGS. 1 and 2 are front and rear perspective views, respectively, of an embodiment of a pulverizer attachment 10 adapted to mount in a convention manner to the stick of an excavator (not shown). The pulverizer attachment 10 includes pivoting upper and lower jaws 100, 200. It should be appreciated that rather than both jaws pivoting about a pivot axis, the pulverizer attachment may be constructed such that only one of the jaws pivots about a pivot axis with the other jaw being fixed.

Figure 5:
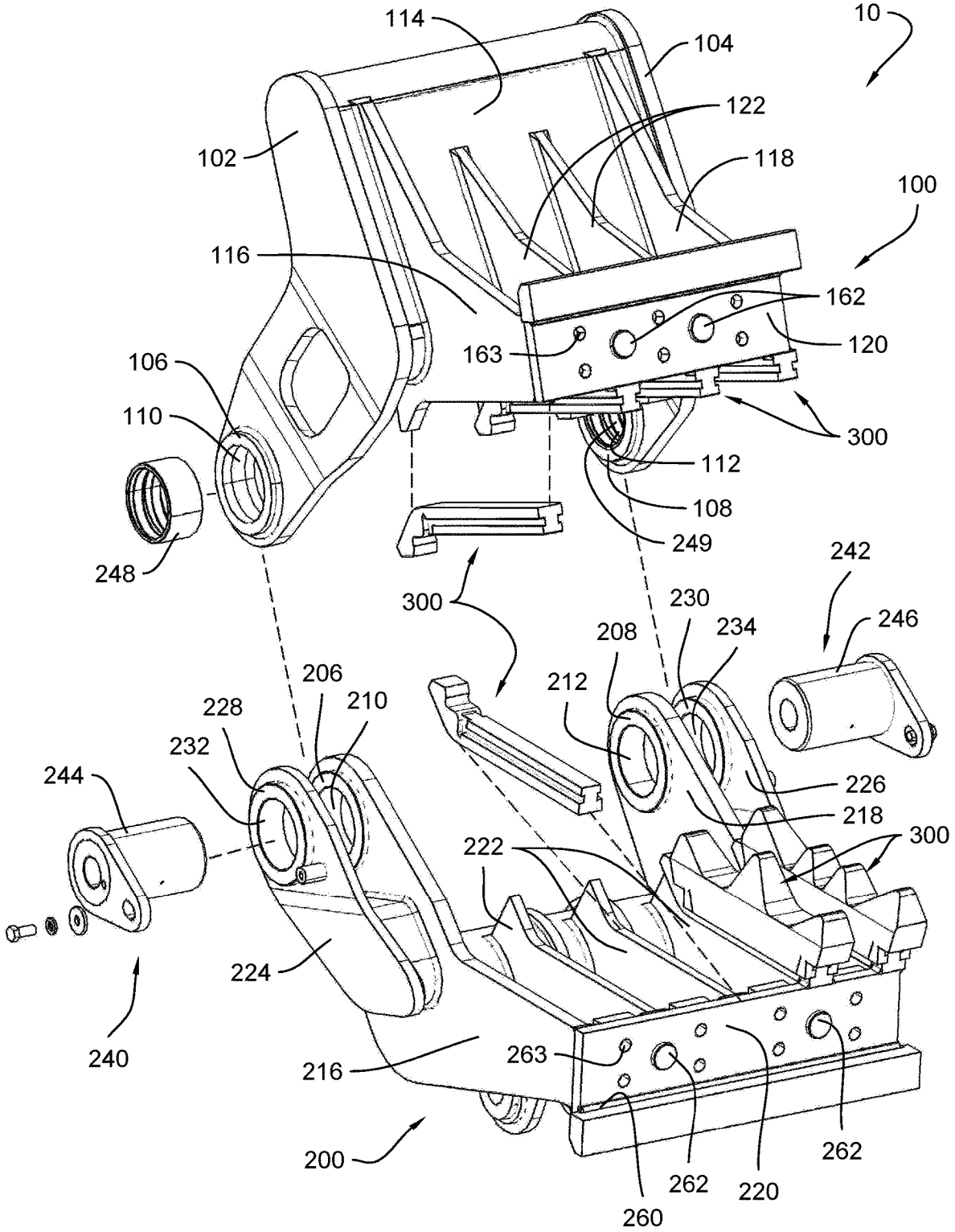
FIG. 5 is an exploded front perspective view of the pulverizer attachment of FIG. 1 with the tooth members removed from the rails.

In this embodiment as best viewed in FIG. 5, the upper jaw 100 comprises left and right side plates 102, 104 with respective pivot hubs 106, 108 having pivot bores 110, 112. A back plate 114 extends between the side plates 102, 104. Left and right upper jaw plates 116, 118 extend forwardly from the back plate 114 and are welded thereto. A front plate 120 extends the width of the upper jaw and is welded to the front ends of the upper jaw plates 116, 118. Gusset plates 122 are spaced between the upper jaw plates 116, 118 and are welded at their rearward end to the back plate 114 and at their forward ends to the front plate 120.

The lower jaw 200 comprises left and right lower jaw plates 216, 218 with respective pivot hubs 206, 208 having pivot bores 210, 212. A rearward tubular member 214 (FIGS. 2 and 8) extends between the lower jaw plates 216, 218. A front plate 220 extends the width of the lower jaw and is welded to the front ends of the lower jaw plates 216, 218. Gusset plates 222 are spaced between the lower jaw plates 216, 218 and are weld at their rearward end to the rearward tubular member 214 and at their forward ends to the front plate 220. Left and right ear plates 224, 226 are welded to the respective left and right lower jaw plates 216, 218. The ear plates 224, 226 have respective hubs 228, 230 with bores 232, 234. The hubs 228, 230 and respective bores 232, 234 are in axial alignment with the hubs 206, 208 and respective bores 210, 212 of the of the lower jaw plates 216, 218.

The left hub 106 of the upper jaw 100 is received between the aligned left hubs 206, 228 of the lower jaw 200. Likewise, the right hub 108 of the upper jaw 100 is received between the aligned right hubs 208, 230 of the lower jaw 200. Left and right pivot assemblies 240, 242 pivotally connect the upper and lower jaws 100, 200. The pivot assemblies 240, 242 comprise pivot pins 244, 246 and bushings 248, 249.

A rearwardly extending clevis mount 250 (FIGS. 2 and 8) is welded to the back side of the rearward tubular member 214 to serve as an attachment point for the stiff arm linkage (not shown) which connects the excavator stick to the lower jaw 200 in a conventional manner.

Figure 6:
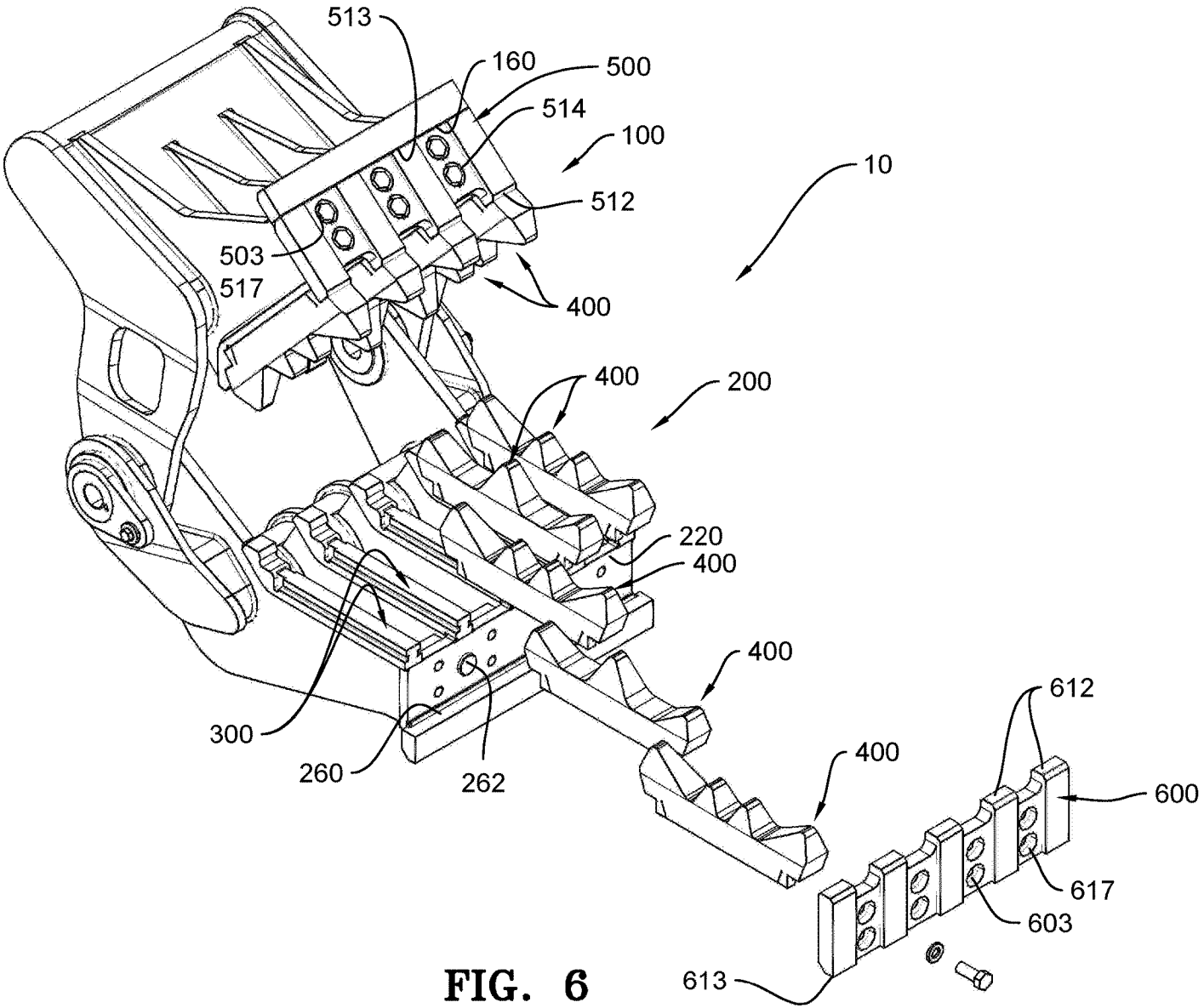
FIG. 6 is an exploded front perspective of the pulverizer attachment of FIG. 1 with the showing the tooth members sliding onto the rails.
Figure 7:
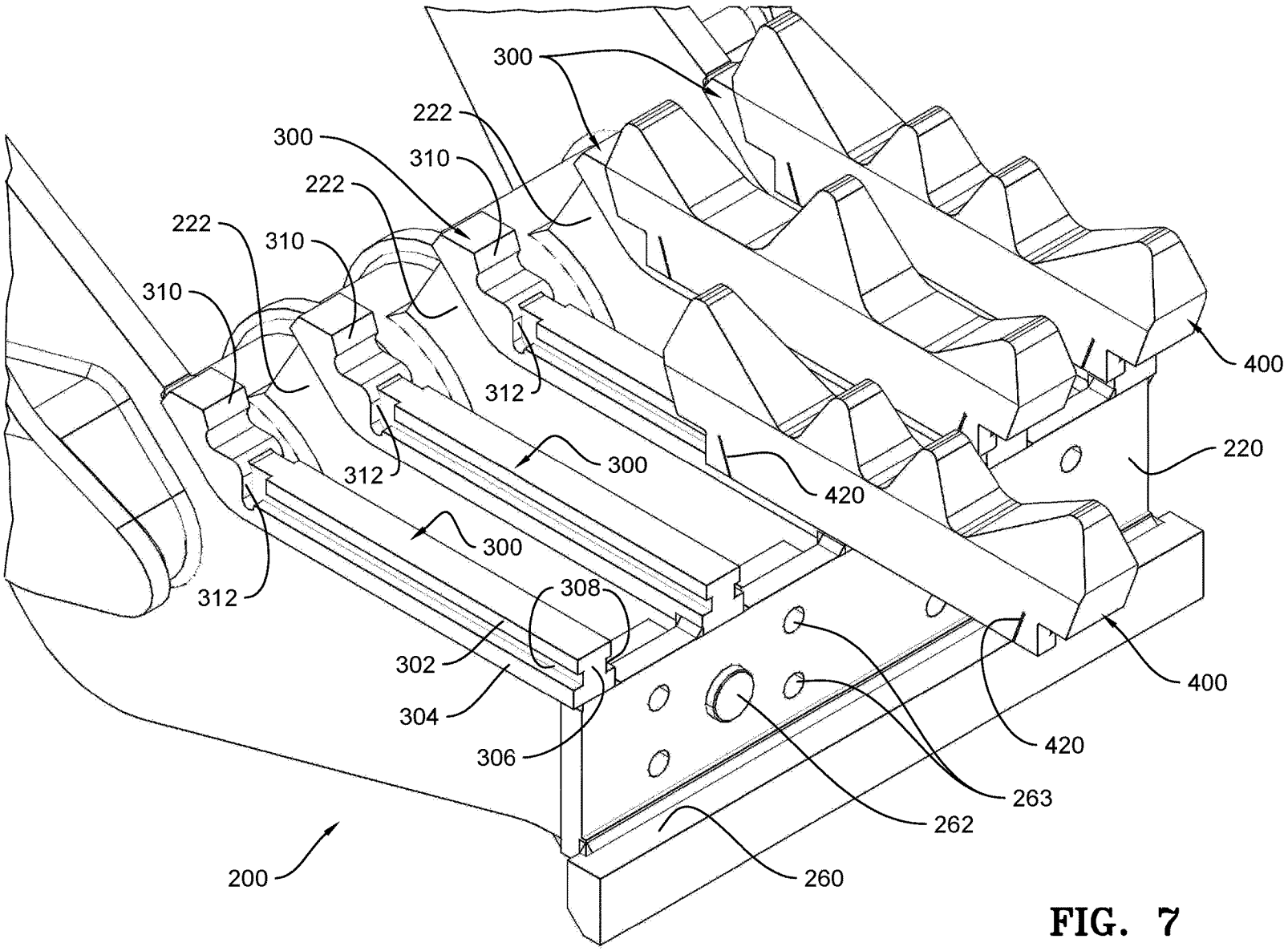
FIG. 7 is an enlarged view of the lower jaw shown in FIG. 6.
Figure 12:
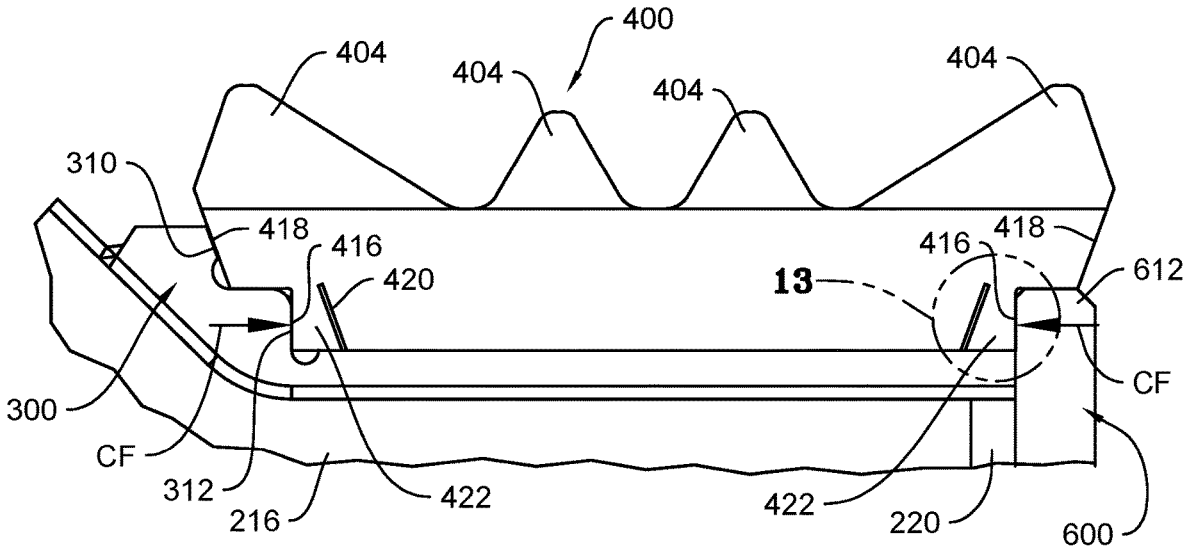
FIG. 12 is a side elevation view illustrating the interference fit of the tooth member.

Referring now to FIGS. 5-8, tooth rails 300 are welded to the top of each jaw plate 116, 118, 216, 218 and each of the gusset plates 122, 222 of the upper and lower jaws 100, 200. In this embodiment, the tooth rails 300 are machined to have an I-shape in cross-section by forming recessed channels 308 along each side, thereby resulting in top and bottom flanges 302, 304 (FIG. 7) separated by a narrower web 306. The rearward end of each tooth rail 300 is stepped so as to form upper and lower rearward stop surfaces 310, 312 (FIGS. 7 and 12). As described below, each tooth rail 300 is adapted to slidably receive a tooth member 400.

Figure 9:
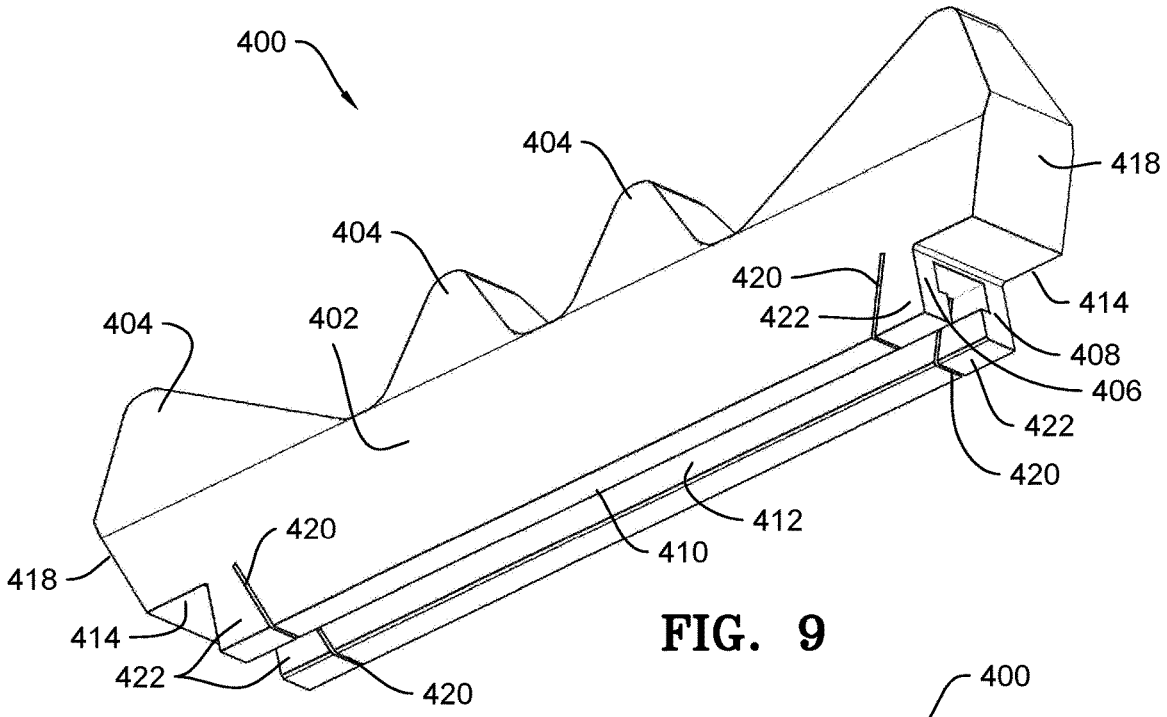
FIG. 9 is a perspective view of an embodiment of one of the tooth members that slides onto the tooth rails.
Figure 10:
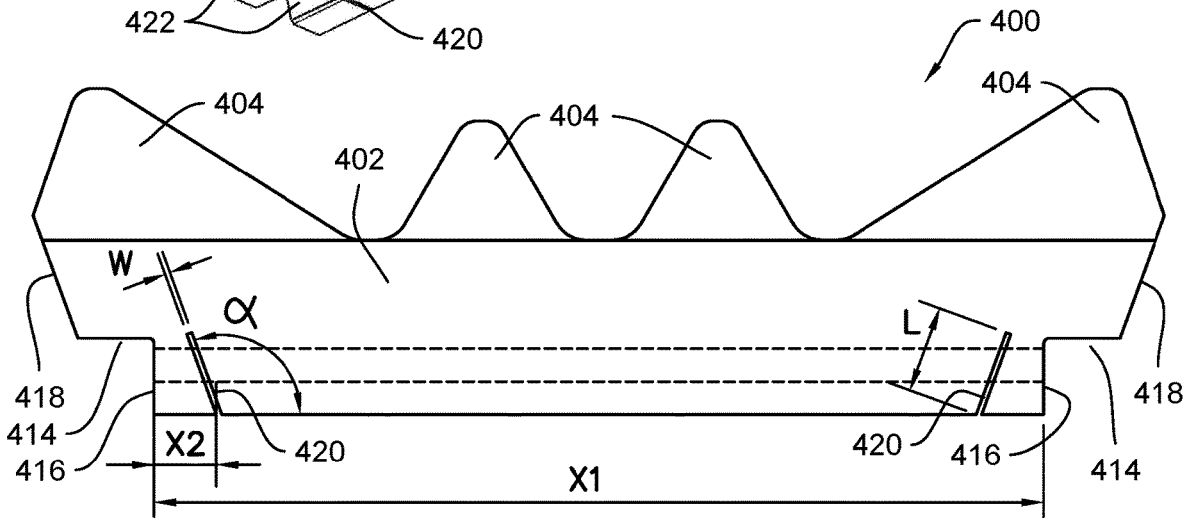
FIG. 10 is a side elevation view of the tooth member of FIG. 9.
Figure 11:
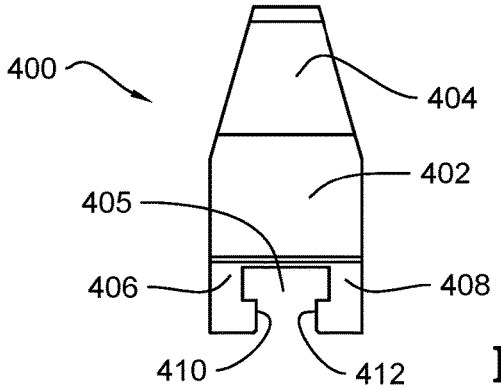
FIG. 11 is an end view of the tooth member of FIG. 9.

As best illustrated in FIGS. 9-11, each tooth member 400 has a body 402 with upwardly projecting teeth 404. The body 402 has a machined longitudinal slot 405 in the shape of a female T through its length, resulting in the lower end of the body having vertical legs 406, 408 (FIG. 11) with inwardly projecting flanges 410, 412. The longitudinal female T-shaped slot 405 slidably receives the top flange 302 and web 306 of the male I-shaped tooth rail 300, whereby the channels 308 of the tooth rail 300 receive the inwardly projecting flanges 410, 412 of the tooth member 400, thereby vertically (i.e., perpendicular to the plane of the flange 302) and laterally (i.e., transverse to the longitudinal slot 405) restraining the tooth member 400 on the tooth rail 300. It should be appreciated that other complimentary slot and rail configurations may be utilized.

Referring to FIGS. 9-13, the body 402 of each tooth member 400 includes lower end notches 414 resulting in a lower abutment surface 416 configured to mate with the stepped lower rearward stop surface 312 of the tooth rail 300. The ends of the body 402 have a sloped upper abutment surface 418 configured to align with the upper rearward stop surface 310 of the tooth rail 300.

The lower portion of each tooth member 400 also includes a narrow machined relief slot 420 extending transversely through the tooth body 402 proximate the abutment surface 418 at each end. The relief slots 420 result in the tooth members 400 having flexible end portions 422 that are capable of resiliently deflecting without plastic deformation. The purpose of which is described later. By way of non-limiting examples, the narrow relief slots 420 may have a width W of approximately 0.06 to 0.25 inches, a length L of approximately 1.50 to 3.0 inches, a slope from horizontal at an angle $\alpha$ of approximately 90 to 135 degrees (as viewed in the orientation shown in FIG. 10), and a start distance X2 of approximately 1 to 3 inches from the lower abutment surface 416. As an example of one embodiment, FIG. 10 shows a tooth member 400 having a length X1 between abutment surfaces 416 of approximately 20.5 inches, a relief slot 420 having a width W of approximately 0.12 inches, a length L of approximately 2 inches, a slope from horizontal at an angle $\alpha$ of approximate 110 degrees, and with the relief slot 420 starting a start distance X2 of approximately 1.5 inches from the lower abutment surface 416. It has been found that the length L, width W, angle $\alpha$, and start distance X2 for the relief slot 420 provides the desired flexibility of the end portion 422 such that it is capable of resiliently deflecting the desired amount without plastic deformation to account for typical manufacturing tolerances, for example a tolerance of 0.001 inches for the overall length X1 between opposing abutment surfaces 416. Those of skill in the art will recognize that that if lower manufacturing tolerances are desired, the dimensions and configuration of the relief slot 420 may need to vary. Additionally, those of skill in the art will recognize that the dimensions and configurations of the relief slot 420 may vary depending on the slot configuration, the width of the tooth body, the wall thicknesses, and the strength of the steel used for the tooth member. For example, mild steel will be more flexible than high strength steel.

It should be appreciated that the length, the female T-slot configuration and the end details of each tooth member 400 may be substantially the same for both the upper and lower jaws 100, 200. Likewise, the length, stepped abutments and I shaped configuration of each tooth rail 300 may be substantially the same length. Accordingly, the tooth members 400 may be reversible (i.e., slidable onto the tooth rails 300 from either end) and interchangeable among any of the tooth rails 300 of both the upper and lower jaws 100, 200.

Figure 3:
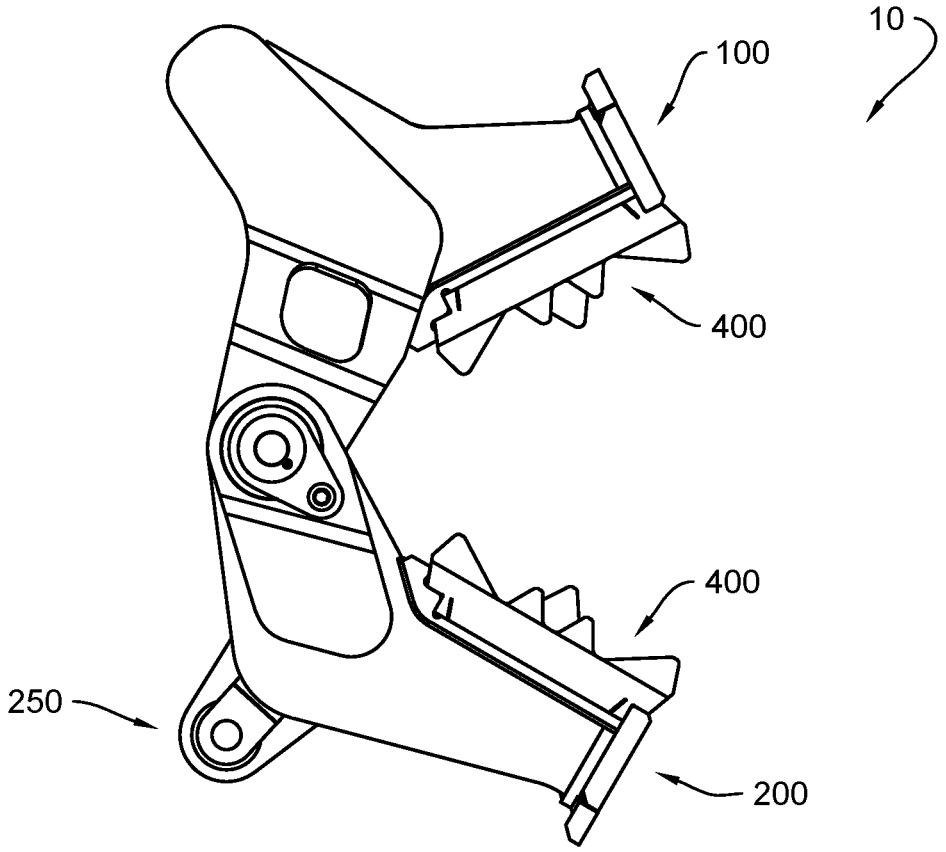
FIG. 3 is a side elevation view of the pulverizer attachment of FIG. 1.
Figure 4:
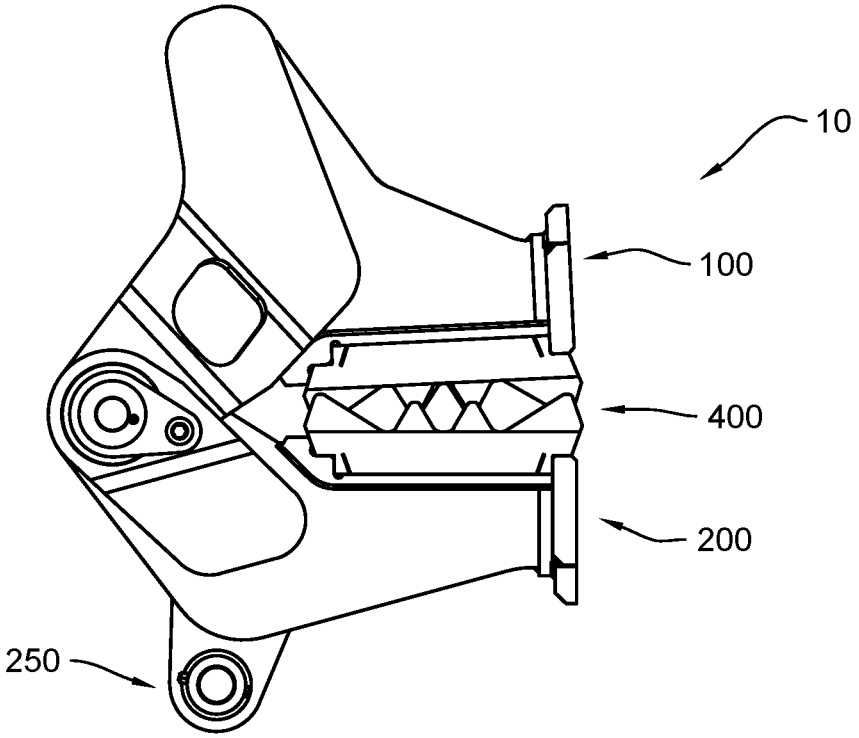
FIG. 4 is a side elevation view of the pulverizer attachment of FIG. 1 showing the jaws closed.

Although the length, female T-slot configuration and end details of each tooth member may be the same, it should also be appreciated that the tooth members 400 may have different teeth configurations. For example, as shown in FIGS. 1 and 3, some tooth members 400 are shown as having four upwardly projecting teeth 404 and others are shown with three upwardly projecting teeth of different sizes. The different teeth configurations may be arranged on the rails 300 as desired for different pulverizing characteristics. It should also be appreciated that the rails 300 and tooth members 400 of the upper jaw 100 are offset from the rails 300 and tooth members 400 of the lower jaw 200 so that when the jaws close, the upper tooth members 400 move into the open slots between the lower tooth members 400. For example, as shown in FIG. 1 the lower jaw 200 has five rows of tooth members 400 and the upper jaw has four rows of tooth members 400 such that the four rows of upper jaw tooth members 400 will align with the four slots between the five rows of lower jaw tooth members 400 as the jaws close.

Referring to FIGS. 2 and 6, after the tooth members 400 are slid onto each of the tooth rails 300 of the upper jaw 100, a cover plate 500 is bolted onto the front plate 120 of the upper jaw 100 through aligned apertures 163, 503 to longitudinally restrain the teeth members 400 onto the rails 300. Similarly, after the tooth members 400 are slid onto each of the tooth rails 300 of the lower jaw 200, a cover plate 600 is bolted onto the front plate 220 of the lower jaw 200 through aligned apertures 263, 603 to longitudinally restrain the teeth members 400 onto the rails 300. As best viewed in FIGS. 2 and 8, spaced tooth retaining ribs 512, 612 are provided along one edge of the cover plates 500, 600 to align with the rails 300 and tooth members 400. The spaced tooth retaining ribs 512, 612 are sized to be received in the notches 414 on the forward end of the tooth members 400. The opposite end 513, 613 of the respective cover plates 500, 600 engages with the respective ledge 160, 260 on the front plates 120, 220 of the respective upper and lower jaws 100, 200.

Figure 8:
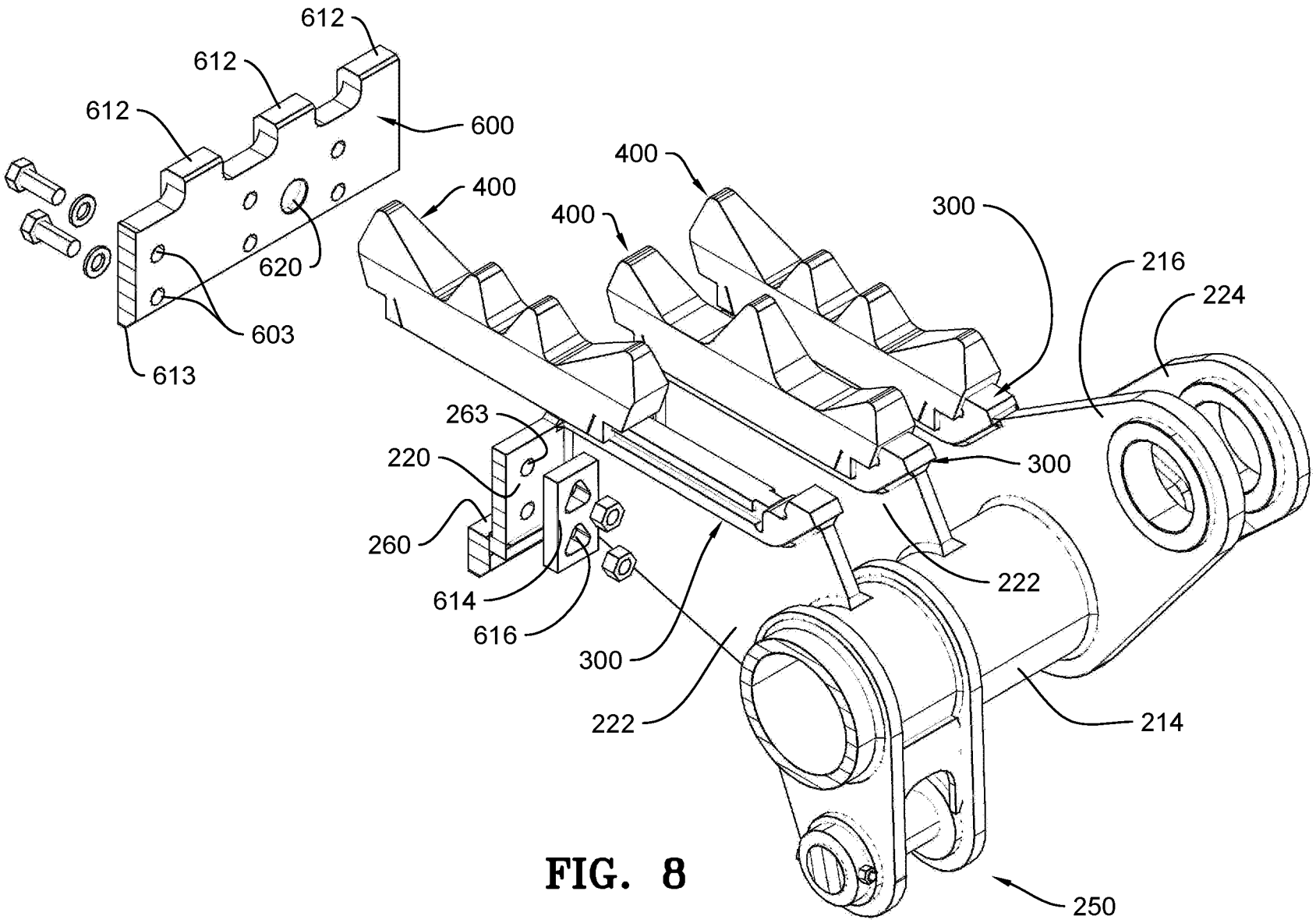
FIG. 8 is an exploded partial rear perspective view of the lower jaw of FIG. 5.

As shown in FIGS. 2 and 8, respectively, nut plates 514, 614 are provided on the inside face of the respective front plates 120, 220. The nut plates 514, 614 include apertures 516, 618 into which the nuts are received to prevent the nuts from rotating while also protecting the nuts from damage during use of the pulverizer attachment 10. Similarly, the front side of the cover plates 500, 600 include bolt head recesses 517, 617 (FIG. 6) into which the bolt heads are received and protected during use of the pulverizer attachment 10. The front plates 120, 220 include forwardly projecting dowels 162, 262 (FIG. 5) which are received into mating recesses 520, 620 (FIG. 8) on the back side of the respective cover plates 500, 600. The forwardly projecting dowels 162, 262 received within the recesses 520, 620 assist in alignment of the cover plates 500, 600 to the front plates 120, 220 and serve to reduce shear stress on the bolts during use of the pulverizer attachment 10.

Figure 13:
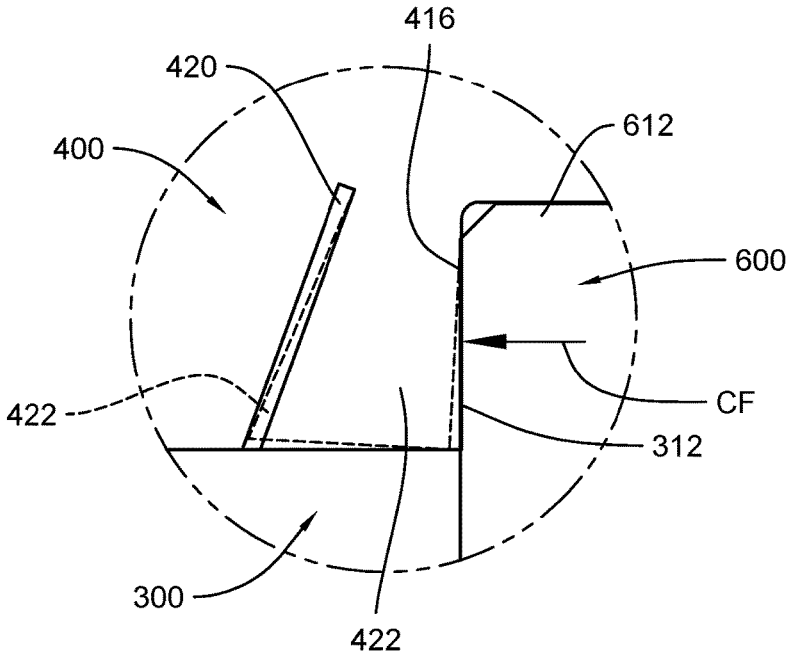
FIG. 13 is an enlarge view of the circled area in FIG. 12 illustrating the deflection of the flexible end portion of the tooth member.

Referring now to FIGS. 12 and 13, the fit of the tooth members 400 onto the rails 300 is illustrated with respect to the lower jaw 200. The fit on the upper jaw 100 is substantially the same as on the lower jaw 200 except that the orientation of the tooth members would be horizontally mirrored and the front plate 120, cover plate 500 and associated tooth retaining ribs 512 would replace the front plate 220, cover plate 600 and associated tooth retaining ribs 612 as shown in FIGS. 12 and 13.

It should be appreciated that the length of the body 402 of the tooth member 400 is slightly greater than the length of the tooth rail 300 as measured from the lower rearward stop surface 312 to the front end of the tooth rail 300, such that when the cover plates 500, 600 are bolted onto the front plate 120, 220, a longitudinal compression force CF (FIG. 12) is exerted against the lower abutment surfaces 416 on each end of the tooth member 400 by the tooth retaining ribs 512, 612. This compression force CF causes the flexible end portions 422 on the tooth members 400 to deflect longitudinally inwardly (see FIG. 13) such that the compression force CF acting on each tooth member 400 in cooperation with the complimentary longitudinal slot and rail configuration serves to rigidly secure the tooth members 400 in place, longitudinally, vertically, laterally and rotationally, thereby minimizing wear between the tooth members 400 and the rails 300 during use.

Additionally, it should be appreciated that the tooth retaining ribs 512, 612 on the cover plate 500, 600 independently engage the notch 414 of each tooth member 400 and allows the flexible end portions 422 of each tooth member 400 to independently deflect the necessary distance to eliminate any gaps and provide a zero clearance fit of the tooth members 400 with the rails 300. Without the independent flexibility of the tooth members enabled by the cooperation of the flexible end portions 422 and the independent tooth retaining ribs 512, 612 on the cover plates 500, 600, shimming would be required to account for some tooth members 400 inevitably being shorter than others or some rails inevitably being longer than others due to manufacturing tolerances.

It should be appreciated that although the rail and tooth assembly described above is in connection with a linkage-style pulverizer attachment, the rail and tooth assembly could be utilized with any pulverizing or crushing-style attachment.

Various modifications to the embodiments and the general principles and features of the apparatus, systems and methods described herein will be readily apparent to those of skill in the art. Accordingly, the scope of the present disclosure is intended to be interpreted broadly and to include all variations and modifications coming within the scope of the appended claims and their equivalents.

The invention claimed is:

1. A pulverizing attachment for an excavator, comprising: a plurality of tooth members, each tooth member having a body portion, the body portion having opposing forward and rearward abutment surfaces defining a body length, each tooth member having a longitudinal slot extending between the forward and rearward abutment surfaces, the longitudinal slot having a pre-defined cross-sectional shape, a relief slot disposed proximate each abutment surface, the relief slot extending substantially transverse to the longitudinal slot through a portion of the body portion thereby producing a flexible end portion capable of deflection upon application of a longitudinal compression force; an upper jaw and a lower jaw, each jaw having a plurality of spaced tooth rails onto which one of the plurality of tooth members is slidably received, each tooth rail having a cross-sectional shape complimentary to the pre-defined cross-sectional shape of the longitudinal slot of the plurality of tooth members, each tooth rail having a length defined by front end and a rearward stop surface, the rearward stop surface abutting the rearward abutment surface of the tooth member slidably received thereon; upper and lower jaw cover plates, each cover plate having a plurality of spaced tooth retaining ribs corresponding to each of the plurality of spaced tooth rails of the upper and lower jaws, each retaining rib abutting the forward abutment surface of each of the tooth members slidably received onto each of the tooth rails, the retaining ribs applying a longitudinal compression force deflecting the flexible end portions of each of the tooth members received on each of the tooth rails; whereby the longitudinal compression force in cooperation with the complimentary shape of the longitudinal slot and the tooth rail, restrain each tooth member with respect to the tooth rail.

2. The pulverizing attachment of claim 1, wherein the body length of each of the plurality of tooth members is slightly longer than the tooth rail length.

3. The pulverizing attachment of claim 1, wherein the relief slot is at an angle with respect to a lower horizontal surface of the tooth body.

4. The pulverizing attachment of claim 1, wherein the longitudinal slot is a T-shaped in cross-section.

5. The pulverizing attachment of claim 1, wherein the tooth rail is I-shaped in cross-section.

6. A method of removably securing teeth to a jaw of a pulverizer, comprising:

(a) sliding a tooth member onto each of a plurality of tooth rails secured to the jaw of the pulverizer, the tooth member having: a body portion, the body portion having opposing forward and rearward abutment surfaces defining a body length; a longitudinal slot extending between the forward and rearward abutment surfaces, the longitudinal slot having a pre-defined cross-sectional shape; a relief slot disposed proximate each abutment surface, the relief slot extending substantially transverse to the longitudinal slot through a portion of the body portion thereby producing a flexible end portion capable of deflection upon application of a longitudinal compression force;

each tooth rail having: a length defined by front end and a rearward stop surface;

a cross-sectional shape complimentary to the pre-defined cross-sectional shape of the longitudinal slot of the tooth member; a rearward stop surface which abuts the rearward abutment surface of the tooth member slidably received thereon; (b) longitudinally compressing the tooth member with a cover plate to cause the flexible end portions of the tooth member to longitudinally deflect; whereby the longitudinal compression in cooperation with the complimentary shape of the longitudinal slot and the tooth rail, restrain each tooth member with respect to the tooth rail.

7. The method of claim 6, wherein the body length of each of the plurality of tooth members is slightly longer than the tooth rail length.

8. The method of claim 6, wherein the relief slot is at an angle with respect to a lower horizontal surface of the tooth body.

9. The method of claim 6, wherein the longitudinal slot is a T-shaped in cross-section.

10. The method of claim 6, wherein the tooth rail is I-shaped in cross-section.

* * * * *